United States Patent [19]

Dischler

[11] Patent Number: 4,947,528

[45] Date of Patent: Aug. 14, 1990

[54] METHOD AND APPARATUS TO ERECT PILE FIBERS

[75] Inventor: Louis Dischler, Spartanburg, S.C.

[73] Assignee: Milliken Research Corporation, Spartanburg, S.C.

[21] Appl. No.: 380,805

[22] Filed: Jul. 17, 1989

[51] Int. Cl.[5] ..... D06C 11/00

[52] U.S. Cl. ..... 26/2 R

[58] Field of Search ..... 26/2 E, 2 R, 25, 29 R

[56] References Cited

U.S. PATENT DOCUMENTS

| | | | |
|---|---|---|---|
| 3,611,757 | 10/1971 | Hills | 26/2 R |
| 4,062,093 | 12/1977 | Klein | 26/2 R |
| 4,301,577 | 11/1981 | Mueller et al. | 26/2 R X |
| 4,468,844 | 9/1984 | Otto | 26/29 R X |

FOREIGN PATENT DOCUMENTS

| | | |
|---|---|---|
| 745070 | 10/1966 | Canada . |
| 2920868 | 11/1980 | Fed. Rep. of Germany . |
| 50-26676 | 9/1975 | Japan . |

*Primary Examiner*—Werner H. Schroeder
*Assistant Examiner*—Bradley K. DeSandro
*Attorney, Agent, or Firm*—Earle R. Marden; H. William Petry

[57] ABSTRACT

A method and apparatus to allow the pile of a pile fabric to become substantially erect by heating the pile fabric to a temperature between the heat setting and dyeing temperatures of the fabric and applying a vibratory force thereto. The vibratory force is applied by impinging a high velocity air stream against a flexible diaphragm over which the heated pile fabric is passed.

25 Claims, 4 Drawing Sheets

FIG. —1—

METHOD AND APPARATUS TO ERECT PILE FIBERS

This invention relates to a method and apparatus to vibrate pile fabrics, particularly synthetic or partly synthetic fabrics, to remove pile distortions created therein after heat setting and/or during dyeing.

In the case of pile fabrics which have been heat set at a high temperature with the pile erect and then dyed at a lower temperature during which the pile is substantially disturbed, as in jet dyeing, it is possible to return the pile to its original erect condition by heating the fabric to a temperature intermediate to that of heat setting and dyeing and simultaneously agitating the fabric, which typically must carry a large static charge for the process to be effective. Pile fabric processed in this way has a clearer, more uniform appearance than pile which has been brushed erect. Several commercial machines are available which can provide this treatment, all of which are very expensive and have various limitations.

One example of such a machine is the tensionless dryer. In this machine the pile fabric is overfed onto a mesh belt which is then transported through a long heated tunnel where either mechanical action or perpendicular air blasts directed through the belt cause the fabric to undergo rather gentle undulations; charging of the fabric occurs by friction with the air or contact with various parts of the dryer. The required residence time results in a unit which may be several hundred feet long and also in low fabric line speeds. There are quality problems associated with lack of edge control in such a long distance and also in marks which may occur when the pile strikes the upper sections of the tunnel.

Another example of a pile conditioning device is the use of a high velocity air jet unit such as disclosed in U.S. Pat. No. 4,837,902. In this case the fabric is heated to the desired temperature and the conditioning is accomplished almost instantaneously by vigorous sawtooth shaped waves that, although small in amplitude, are extremely effective due to the high accelerations normal to the fabric surface produced by the combination of small bending radius and high wave velocity. The disadvantage to the process is direct contact of the heated fabric with the air stream, which tensions the fabric and can set in distortions in sensitive knit fabrics. Also, this process is less effective with highly permeable fabrics, as the air may not be adequately trapped between fabric and plate.

It is therefore an object of the invention to provide an efficient apparatus and method to remove the pile distortions in a pile fabric after it has been processed.

Other objects and advantages of the invention will become readily apparent as the specification proceeds to describe the invention with reference to the accompanying drawings, in which.

Figure 1:
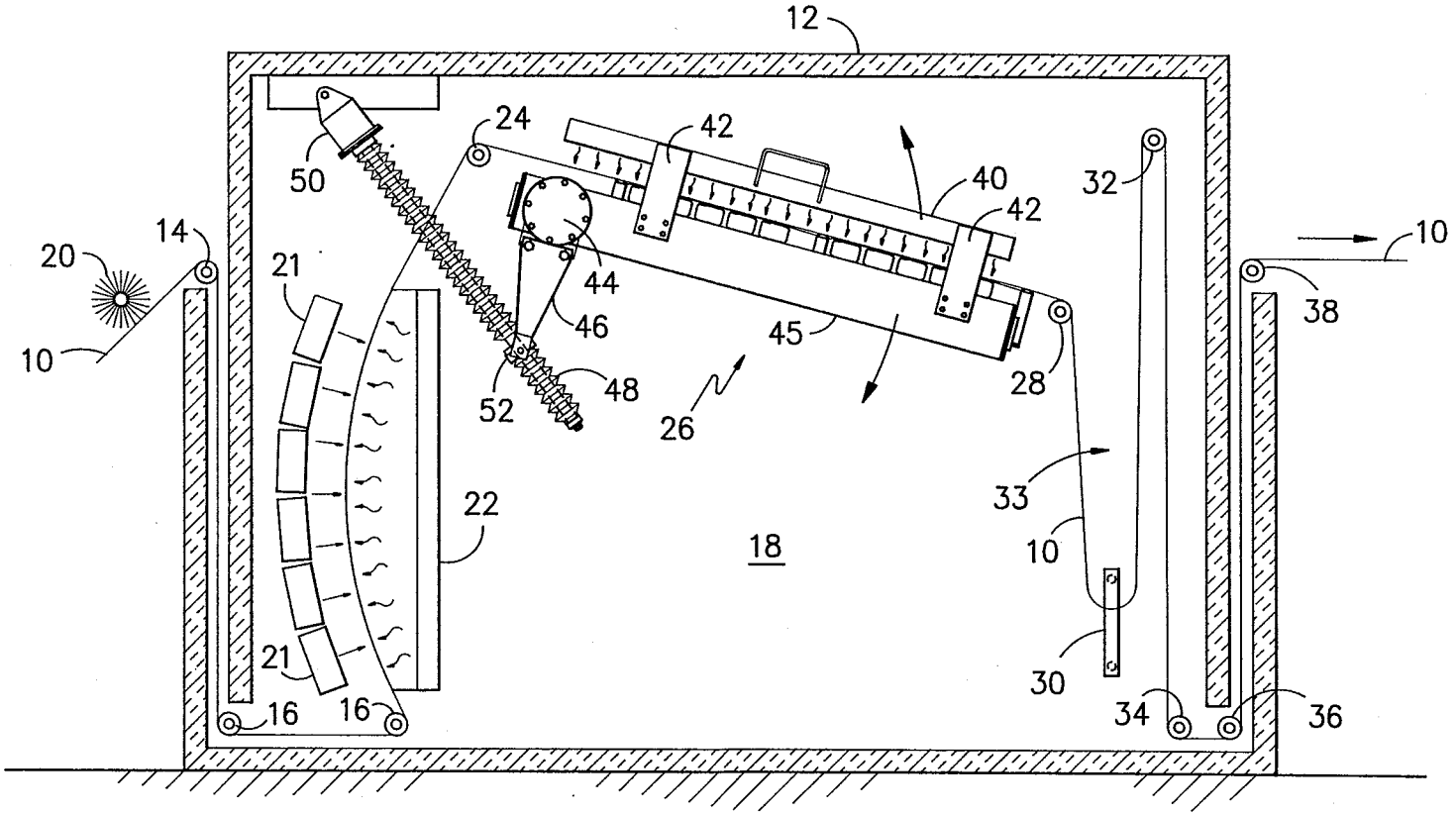
FIG. 1 is a schematic side elevation view of the pile removal apparatus per se.
Figure 2:
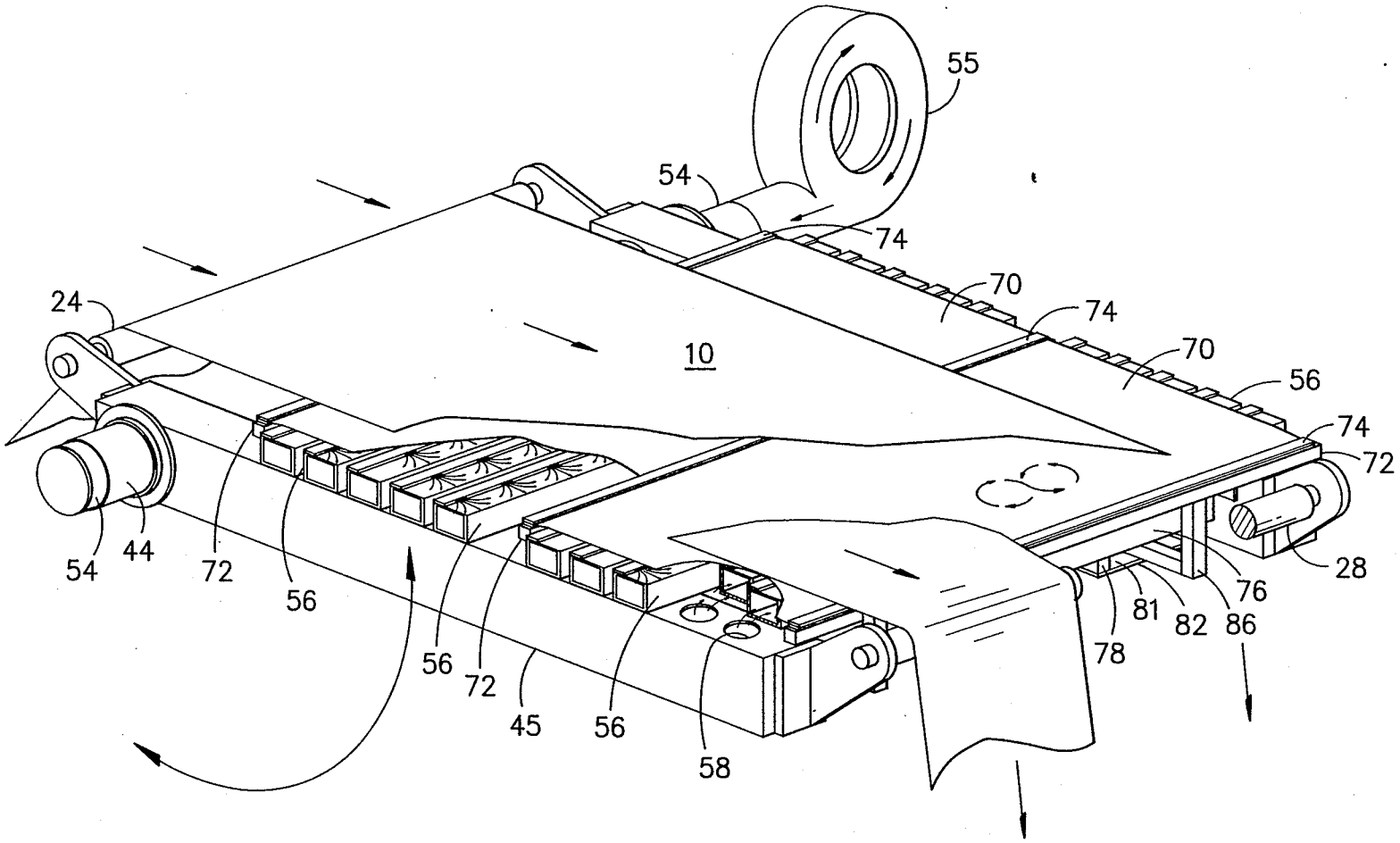
FIG. 2 is an isometric view of the pile removal apparatus per se.

Looking now to FIG. 1, the basic system is shown wherein a synthetic or partially synthetic, woven, tufted or knit pile fabric 10, is being supplied to the treatment apparatus 12. The pile fabric 10 is delivered over idler rolls 14 and 16 into the treatment chamber 18 after the pile surface thereof has been brushed by the brush 20 to remove any accumulated deposit on the surface thereof. From the rolls 16 the fabric 10 passes through the heating section between the radiant heaters 21 and the steam heated plate 22 to the idler roll 24. If desired, the fabric 10 can be charged either prior to or while being treated in the pile erector 26. This may be accomplished by using ionizing bars to spray charge onto the fabric to be treated or by frictional contact of the fabric with the vibrating diaphragm which, in the latter case, should have a surface resistance less than 100,000 ohms/square for adequate charging. From the roll 24 the fabric 10 passes through the pile erector 26 to the driven roll 28. From the roll 28 the treated fabric is delivered successively through the conventional accumulator 30, over the roll 32 through the cooling zone 33, under the rolls 34 and 36 to the roll 38 where it is guided out of the treatment apparatus 12.

The radiant heater 21 facing the pile surface of the fabric 10 and the steam heated plate 22 facing the back side of the fabric, collectively, raise the temperature of the fabric to a temperature between the heat setting temperature and the dyeing temperature of the fabric 10. This temperature will vary according to the particular fabric being processed. To maintain this selected temperature during processing another steam heated plate 40 is mounted, facing the pile side of the fabric 10, by suitable members 42 to the pile erector 26.

The pile erector 26 is pivotally mounted through journal 44 connected to the sides 45 of the pile erection 26 and telescoping the hollow shaft 54 which is mounted to the sides of the apparatus 12. An arm 46 is connected to the journal 44 at one end and engages the screw member 48 at the other end. An air motor 50 is located at the upper end of the screw member 48 to rotate same to cause the nut 52 to move up or down the screw, depending on the direction of rotation, to pivot the free end of the pile erector 26 either upward or downward. The desired pivotal movement of the pile erector 26 encompasses approximately 90°. This pivotal movement allows ready access to the chamber 18 and the pile erector 26 by the operator for purposes of inspection, repair, cleaning, etc.

As discussed briefly before the pile erector 26 is supported in the chamber 18 by the hollow shaft 54 which extends across between the walls of the apparatus 12. Connected to one end of the shaft 54 outside of the sides of the apparatus 12 is a fan or blower 55 supplying hot or cold air into the hollow shaft 54. From the hollow shaft 54, the supplied air is delivered into the interior of both of the support members 45 through openings (not shown). Mounted across the pile erector 26 on top of the members 45 are a plurality of air manifolds 56 having openings therein (not shown) which cooperate with the openings 58 in the top of member 45 to receive air from the interior of the member 45. The manifolds 56 are secured in position by screws 57 projecting through the angle iron members 59 welded or otherwise secured to the inside wall of the member 45. As shown in detail in FIG. 5 each of the manifolds 56 is notched at the back and has an elongated strip 60 extending across the width thereof. The strip 60 has a plurality of notches 62 therein to cooperate with matching holes 64 in the air manifold 56 to allow air to be projected outwardly from the jet 66 formed by the bottom of the top of the notch 62 and the top surface 68 of the air manifold 56. If desired for maximum efficiency the jet 66 can be manufactured to provide a converging-diverging shape.

For reasons hereinafter explained an impermeable, conductive, flexible, heat and fatigue resistant diaphragm 70 of silicone rubber, Teflon coated fiberglass or other like material is secured above the air manifolds 56 and below the path of travel of the fabric 10 to suitable bars 72. In use, as hereinafter explained, the upper surface of the diaphragm 70 is contacted by the fabric 10 as it travels through the pile erector 26 and, if not charged, should be charged while in contact with the diaphragm 70.

Figure 3:
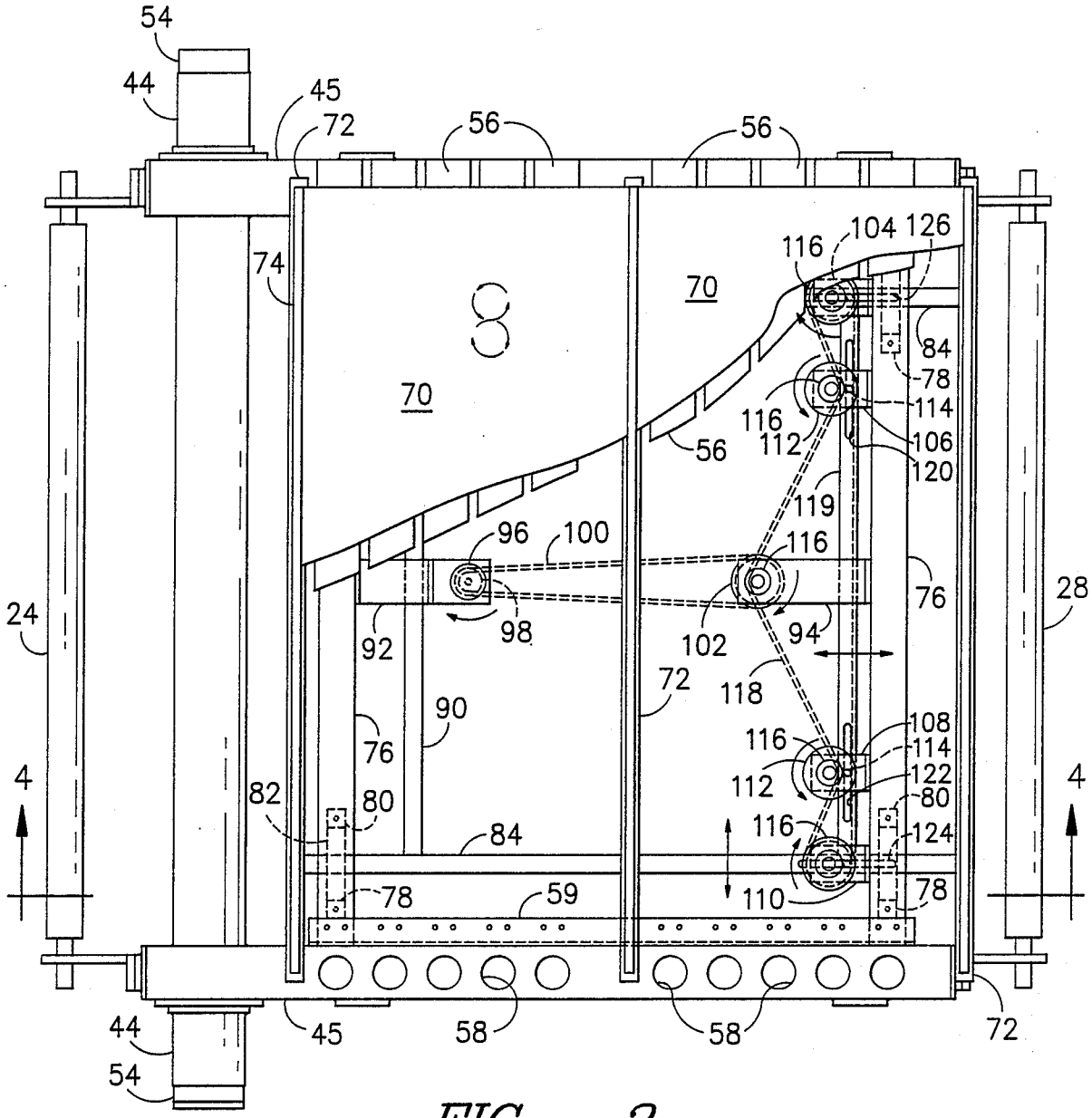
FIG. 3 is a top view of the apparatus shown in FIG. 2 with parts removed to show the interior thereof.
Figure 4:
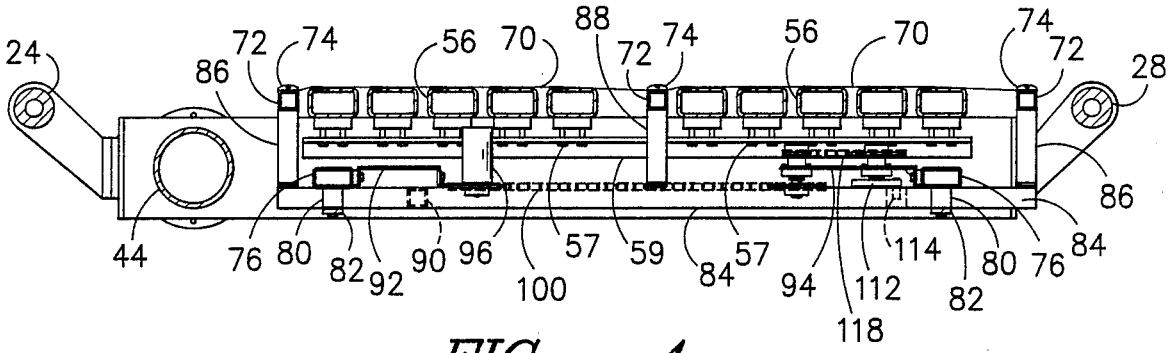
FIG. 4 is a side view of FIG. 3 taken on line 4—4.

To prevent excessive wear on the upper surface of the diaphragm 70 the mechanism shown in FIGS. 3 and 4 is used to move the diaphragm longitudinally and transversely to vary the areas of contact of the diaphragm by the air from jets 66. The diaphragm 70 is secured to bars 72 by elongated cap members 74 securing the fabric 70 therebetween. Mounted between and secured to the members 45 at both ends thereof are hollow bars 76. Supported under each end of the hollow bars 76 and spaced therefrom by blocks 78 and 80 is a plate member 82 which provides a space 81 between the plate member 82 and the underside of the bar 76. Slidably supported in the space 81 is a bar 84 which has an upturned member 86 which supports the bar 72 to which it cooperates. Additional bars 88 are connected to bar 84 to support the center bar 72. An additional cross bar 90 is connected between the bars 84 to cause them to act in tandem.

Screwed or otherwise secured to the hollow bars 76 are support plates 92 and 94. Plate 92 rotably supports the drive motor 96 for the pulley 98 driving the timing belt or chain 100 which drives the pulley 102 rotably mounted in on the plate 94. Also connected to the hollow bar 76 that the plate 94 is connected to are four support plates 104, 106, 108 and 110. Rotably mounted in each of said plates is a cam member 112 with a pin 114 projecting downwardly therefrom. Above the cam member 112 fixed to the shaft for the cam member is a pulley 116. All of the pulleys are driven by the timing belt or chain 118 driven by the pulley 102. Mounted between the bars 84 is another bar 119 which has slots 120 and 122 therein. Each of the bars 84 also have slots 124 and 126 therein. Each of the pins 114 project downwardly into the slot adjacent the pulley 116 to which its cam member 112 cooperates.

It can be seen that the continuously driven motor 96 through the driving belts 100 and 118 will cause the pins 114 in the slots 120 and 122 to cause the bar 119 to slide in the space 81 parallel to the path of travel or the warp direction of the fabric 10 and the pins 114 in the slots 124 and 126 will cause the bar 119 to slide in the space which is parallel to the weft direction of the fabric. Since the bar 119 is connected to the bars 84 to which the fabric support bars 72 are connected, the diaphragm 70 will have a continuous motion which is a composite of parallel and perpendicular motion of the bar 119 to continuously move the surface of the diaphragm 70 to spread the wear thereon by air from the jets 66. This continuous movement provides a longer service life for the diaphragm 70.

Figure 5:
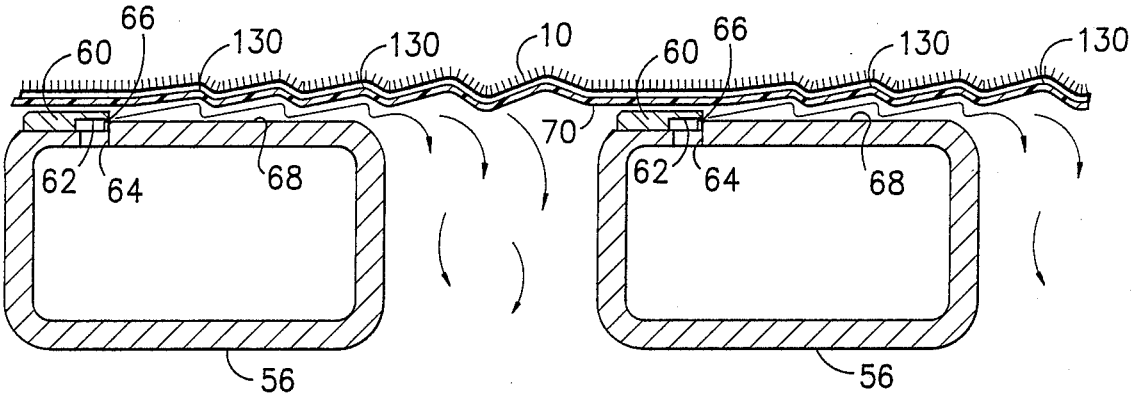
FIGS. 5 and 6 are side and top views, respectively, of a portion of the apparatus shown in FIG. 2 to illustrate the principles of the invention.
Figure 6:
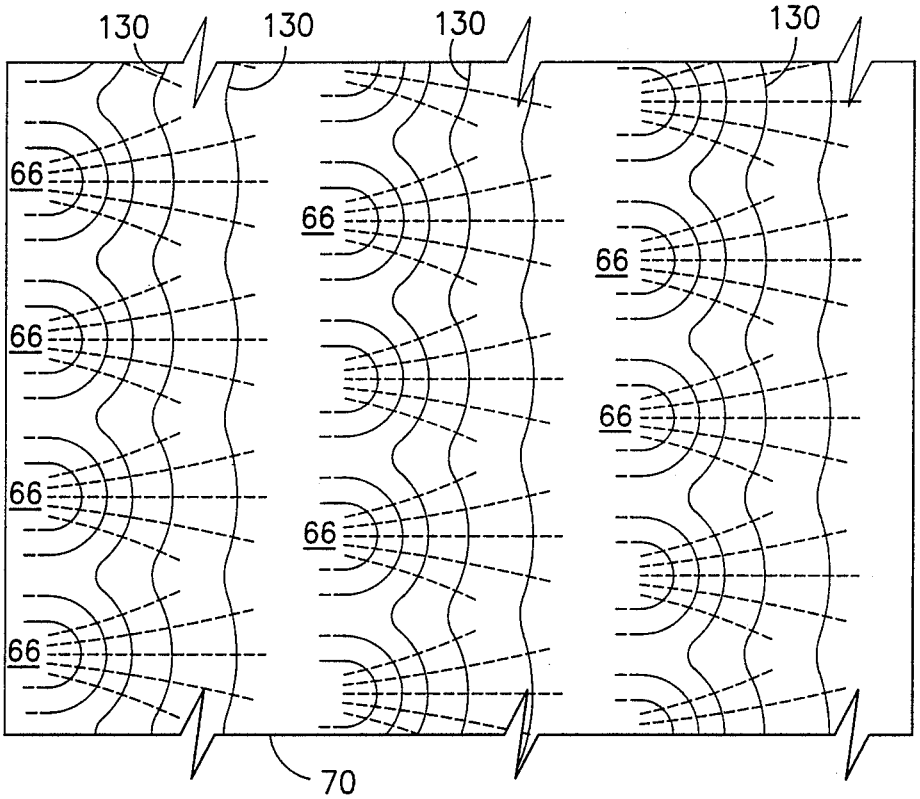

Looking at FIGS. 5 and 6 the action of the high velocity air from the jets 66 on the flexible diaphragm or fabric 70 and the pile fabric 10 being processed is schematically represented. Since the jets 66 are not continuous across the pile erector 26 and are staggered in relation to the jets 66 in the next adjacent row the air flow therefrom creates a series of waves 130 the peaks of which in FIG. 6 are represented by curvilinear lines. Because of the complex waveform created by the staggered jets, the heated pile fabric 10 follows the contour of the diaphragm 70 created by the series of jets 66, as shown in FIG. 5. A continuous jet would produce more or less continuous waves which would cause the fabric to be bounced from the vibrating diaphragm, resulting in intermittent contact and reduced treatment. It should be noted that the curvilinear lines 130 adjacent the jets 66 are sharper and then dampen out as the air flow from the jets 66 diverges until the area adjacent the next adjacent series of jets is substantially flat. The continuous repeated action of the air from the series of jets 66 causes the pile fibers of the fabric 10 to assume the erect position. An example of a fabric which has been successfully treated by the herein-disclosed apparatus is a double needle bar 44 gauge knit polyester velvet having 70 denier, 54 filament polyester face yarns and 70 denier, 34 filament polyester ground yarns. The fabric was knit in sandwich form and heat set at a temperature in the range of 380°–415° F. The fabric was then slit to form two fabrics which were then dyed in a pressurized jet dyeing machine at a temperature in the range of 260°–287° F. The fabric was then backcoated and delivered to the pile erection machine. The fabric was then delivered to the pile erector at a temperature in the range of 300°–340° F. to the air jets which were operating in the range of 1.5–4.0 p.s.i.g., preferably 3.0 p.s.i.g., whereat the fibers were erected to provide a smooth velour-type surface.

The herein-disclosed apparatus provides a very compact and efficient method to treat the fibers of a pile fabric to enhance the appearance thereof. Prior to this invention tensionless dryers have been used in an attempt to accomplish the desired result but these dryers did not provide the desired effect and required large floor areas because of their bulkiness. The discontinuous slot arrangement along with the use of the intermediate diaphragm provides a system which is more easily controlled and results in a much more uniform product.

Although the preferred embodiment of the invention has been described, it is contemplated that changes may be made without departure from the scope or spirit of the invention and it is desired that the invention be limited only by the scope of the claims.

I claim:

1. Method to erect the fibers of a synthetic pile fabric comprising the steps of: supplying a web of pile fabric, heating the pile fabric to a temperature between the heat setting and dyeing temperature of the fabric, supplying the pile fabric over and in contact with a diaphragm, supplying a plurality of separate air streams against the underside of the diaphragm to create a plurality of waves therein to create waves in the pile fabric to cause the fibers therein to become erect and supplying the pile fabric with erect fibers to a point of take-up.

2. The method of claim 1 wherein the air streams are supplied at high velocity against the diaphragm.

3. The method of claim 2 wherein the air streams are supplied at a low pressure.

4. The method of claim 3 wherein the pressure of the air supplied is in the range of 1.5–4.0 p.s.i.g.

5. The method of claim 3 wherein the pressure of the air supplied is approximately 3.0 p.s.i.g.

6. The method of claim 1 wherein the diaphragm is continuously moved with respect to the supplied fabric to increase the service life of the diaphragm.

7. The method of claim 1 wherein the air streams are supplied from a plurality of jets located across the underside of the diaphragm and a plurality of rows of air jets spaced downstream from one another.

8. The method of claim 7 wherein the air streams from one row are staggered in relation to the air streams in the next adjacent row.

9. The method of claim 8 wherein the diaphragm is continuously moved with respect to the jets to increase the service life of the diaphragm.

10. The method of claim 9 wherein the pressure of the air supplied is in the range of 1.5–4.0 p.s.i.g.

11. The method of claim 1 wherein the pile fabric is charged.

12. The method of claim 11 wherein the pile fabric is charged prior to contact with the diaphragm.

13. The method of claim 11 wherein the pile fabric is charged while in contact with the diaphragm.

14. The methods of claim 11, 12 or 13 wherein the surface resistance of the diaphragm is less than 100,000 ohms/square.

15. The method of claim 1 wherein the pile fabric is brushed prior to being heated.

16. Apparatus to erect the pile fibers of a synthetic pile fabric comprising: a frame, a first heater means mounted in said frame, a pile erector mounted in said frame, a first means to supply fabric into operative relationship with said heater means and then onto said pile erector and a second means to direct fabric from said frame after passage over said pile erector, said pile erector including a plurality of rows of air ejectors, each of said rows being a plurality of air ejectors, a diaphragm connected to the top of said erector over said rows of air ejectors and under the path of travel of the pile fabric, said air ejectors blowing high velocity air against the underside of said diaphragm to create waves therein.

17. The apparatus of claim 16 wherein the air ejectors in one row are staggered in relationship to the air ejectors in the next adjacent rows.

18. The apparatus of claim 17 wherein said pile erector includes a means to oscillate said diaphragm to reduce the wear thereof.

19. The apparatus of claim 17 wherein the air supplied to said air ejectors is within a range of pressure of 1.5 to 4.0 p.s.i.g.

20. The apparatus of claim 18 wherein the air supplied to said air ejectors is at a pressure of about 3.0 p.s.i.g.

21. The apparatus of claim 16 wherein a second heater means is mounted above the path of travel of the pile fabric over the pile erector.

22. Apparatus to treat the pile fibers of a pile fabric comprising: a frame, said frame having two hollow support members spaced from one another, a hollow shaft member mounted through said support members and being in communication with the interior of each of members, air supply means operably associated with said shaft member, a plurality of air manifolds mounted across said support members and spaced from one another, means supplying communication between said support members and said air manifolds, each of said manifolds having a plurality of air jets and a diaphragm movably mounted above said air jets.

23. The apparatus of claim 22 wherein the air jets in one manifold are staggered in relation to the air jets in the next adjacent manifold.

24. The apparatus of claim 23 wherein said pile erector includes a means to oscillate said diaphragm.

25. The apparatus of claim 24 wherein a heater means is mounted to said frame above said diaphragm.

* * * * *